US005876152A

United States Patent [19]

Hesse

[11] Patent Number: 5,876,152

[45] Date of Patent: Mar. 2, 1999

[54] RAMMING DRILL FOR DESTRUCTIVE REPLACEMENT OF BURIED PIPELINES

[75] Inventor: Alfons Hesse, Lennestadt, Germany

[73] Assignee: Tracto-Technik Paul Schmidt Spezialmaschinen, Lennestadt, Germany

[21] Appl. No.: 612,559

[22] Filed: Mar. 8, 1996

[30] Foreign Application Priority Data

Mar. 9, 1995 [DE] Germany ..... 195 08 450.0

[51] Int. Cl.[6] ..... F16L 1/00

[52] U.S. Cl. ..... 405/184; 405/154; 175/22

[58] Field of Search ..... 405/154, 156, 405/184; 138/97; 175/19, 22, 293, 295, 296; 30/92.5

[56] References Cited

U.S. PATENT DOCUMENTS

| | | | |
|---|---|---|---|
| 4,634,313 | 1/1987 | Robbins | 405/154 X |
| 4,637,756 | 1/1987 | Boles | 405/154 X |
| 4,648,746 | 3/1987 | Abinett | 405/154 X |
| 4,720,211 | 1/1988 | Streatfield et al. | 405/154 |
| 4,732,222 | 3/1988 | Schmidt | 175/22 |
| 5,013,188 | 5/1991 | Campbell et al. | 405/154 X |
| 5,076,731 | 12/1991 | Luksch | 405/154 |
| 5,112,158 | 5/1992 | McConnell | 405/156 X |
| 5,127,481 | 7/1992 | Hesse | 175/295 |
| 5,133,416 | 7/1992 | Dobroselsky et al. | 175/19 |
| 5,161,626 | 11/1992 | Laffkas | 175/296 X |
| 5,173,009 | 12/1992 | Moriarty | 405/154 |
| 5,306,101 | 4/1994 | Rockower et al. | 405/134 |

FOREIGN PATENT DOCUMENTS 40 42 140 C1 2/1992 Germany .

*Primary Examiner*—Tamara L. Graysay
*Assistant Examiner*—Frederick L. Lagman
*Attorney, Agent, or Firm*—Merchant, Gould, Smith, Edell, Welter & Schmidt, P.A.

[57] ABSTRACT

Ramming drill for destructive replacement of buried pipelines with a conical tip, a crushing head set onto the conical tip with radial cutters and a traction cable acting on the equipment tip.

11 Claims, 2 Drawing Sheets

RAMMING DRILL FOR DESTRUCTIVE REPLACEMENT OF BURIED PIPELINES

SUMMARY

Figure 1:
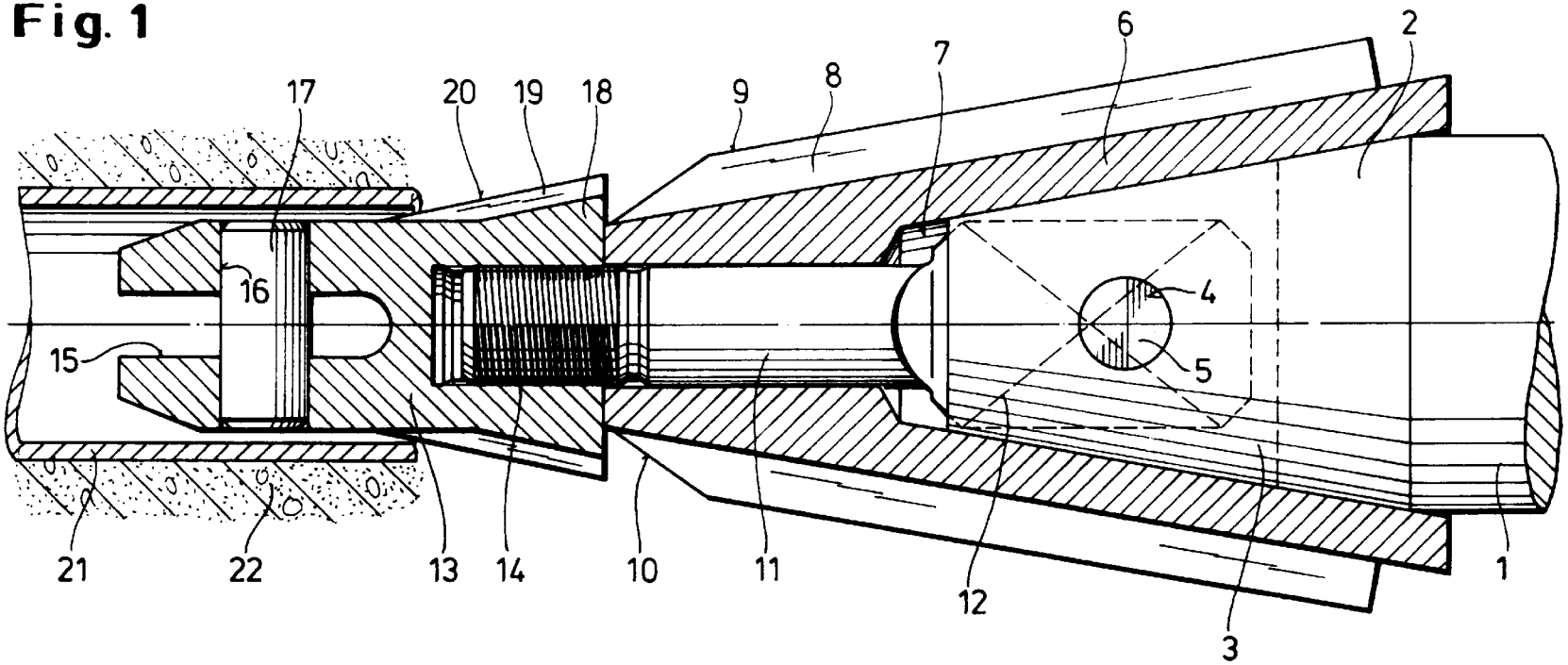

The invention pertains to a ramming drill for destructive replacement of buried pipelines.

Ramming drills of this type are known and feature radial cutters that crush or fragment the old, irrepairable line made of masonry, steel or cast iron, unreinforced concrete or plastic, during the advance of the ramming drill.

A device of this type is described in German Patent No. 4,014,775. This ramming drill features a conical housing tip with an attached traction cable and an expansion cone at the equipment tail. In the vicinity of the cylindrical portion of the housing, there are radial cutters. This known ramming drill has proven useful in the fragmentation of relatively large pipelines in soft soil, but is only suitable for pipelines whose inner diameter is greater than the diameter of the housing of the ramming drill.

The invention is based on the problem of creating a ramming drill for destructive replacement of buried pipelines that can be used for fragmentation of pipelines with an inner diameter smaller than the outer diameter of the housing of the ramming drill, which allows a simple adaptation to the old pipe diameter and the diameter of the new pipe, and also ensures an easy replacement of worn cutters.

Proceeding from this problem description, the invention comprises a device of the above-mentioned type, in which a fragmentation head preferably with radial cutters is set preferably onto the conical tip of the ramming drill, in accordance with the present invention, the traction cable is attached to the tip of the ramming drill and is shielded by a cable casing. The cable casing prevents damage to the traction cable from fragments of the old pipe, which can be produced very easily from the brittle pipes.

The fragmentation head can thus be designed conically, so that its radial cutters can increase from a diameter of the cone that is smaller than the cylindrical housing diameter, up to a diameter that is equal at least to the diameter of the cylindrical part of the housing. Therefore, pipelines can be destroyed whose inner diameter is less than the outer diameter of the cylindrical housing of the ramming drill.

If the cutters on the fragmentation head are worn, then the fragmentation head can be easily replaced by a new one or the fragmentation head can be removed and repaired.

Preferably the tip of the ramming drill can have an axial opening for a traction cable or a traction cable adapter and a transverse hole for a mounting bolt for the traction cable or of the traction cable adapter, so that the opening for the traction cable or the traction cable adapter and the mounting bolt is located within the fragmentation head and is shielded against external effects.

If the traction cable is attached directly in the axial opening of the equipment tip, the advantage obtained is that no components are located in front of the equipment tip.

If the traction cable adapter consists of a tie rod with an eyelet for the mounting bolt and an eyelet screwed to the free end of the tie rod projecting from the fragmentation head for the traction cable, then the fragmentation head can be tightly clamped to the conical tip of the ramming drill, so that no wear will occur due to a loose seating of the fragmentation head on the tip of the ramming drill, and so that the impact energy acting on the equipment tip is transferred directly to the fragmentation head.

Furthermore, it is advantageous when the eyelet features a conically expanding region with radial cutters neighboring the front end of the fragmentation head, since the region of the eyelet to which the traction cable is attached can be adapted to the inner diameter of the pipeline being destroyed, and the fragmentation begins at the conically expanding region of the eyelet by means of the cutters. Because of the tensioning of the eyelet, of the fragmentation head and of the conical equipment tip due to the tie rod, the impact energy of the ramming drill is also transferred without loss to the eyelet.

The radial cutters at the fragmentation head cause the final fragmentation of the pipeline and its destruction into small fragments that can be easily pressed into the soil on the side during the advance of the ramming drill.

For this purpose, it is advantageous for a pair of diametrically opposing cutters to be aligned at the conical region of the eyelet and at the fragmentation head. In this case, the cutting edges of the cutters at the conical region of the eyelet and at the fragmentation head can be aligned in a conically expanding manner and the cutters can be beveled at the front end of the fragmentation head at a height that is less than the rear diameter of the conical region of the eyelet.

The cable casing consists preferably of at least one elastic sleeve surrounding the cable; said sleeve can be surrounded by a guide casing. The sleeve and the guide casing are slotted, preferably parallel to the axis, so that they can be easily brought to the traction cable. The cable casing can be securely clamped to the traction cable by means of a cable clamp which prevents displacement of the cable casing on the traction cable.

If several sleeves and several guide casings are placed on the traction cable, the impact sites between the sleeves and the casing should be positioned axially offset to each other.

The invention will be explained in greater detail below based on one embodiment shown in the figures*. Shown are:

[Editor's note: Figures omitted in the original text.]

FIG. 1: A cutaway view of the front end of a ramming drill with fragmentation head set on.

Figure 2:
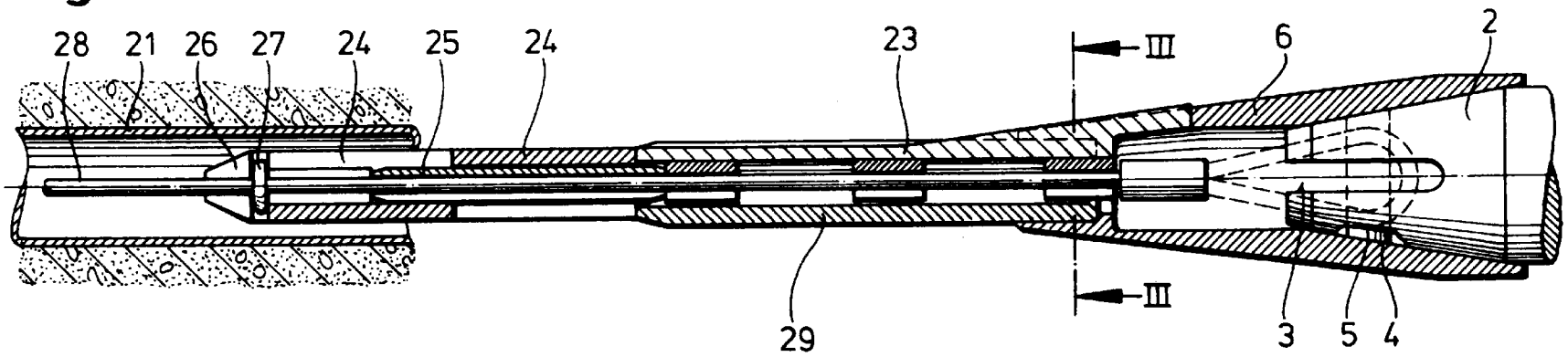

FIG. 2: A cutaway view similar to FIG. 1, but with traction cable directly attached to the equipment tip, and FIG. 3: A cross section along line III—III in FIG. 2.

Only a partial region of the ramming drill 1 and its cylindrical housing with its conical tip 2 is presented. The conical tip 2 can be designed as a single part with the housing of the ramming drill 1 or set onto the housing; it features an axial opening 3 in the form of a slot and a transverse hole 4 for insertion of a mounting bolt 5.

A fragmentation head 6 likewise of conical design is inserted by its conical hole 7 onto the tip 2 of the ramming drill 1. The fragmentation head 6 features radial cutters 8 with sharpened cutting edges 9 that extend across almost the entire length of the fragmentation head 6, which are positioned radially opposite each other, and whose cutting edges 9 run approximately parallel to the conical surface of the fragmentation head 6. At the front end of the fragmentation head 6, the cutting edges 9 feature a bevel 10 so that the height of the cutters 8 in this region only slightly exceeds the small diameter of the fragmentation head 6. A tie rod 11 extends through an axial hole in the fragmentation head 6; this tie rod has an eyelet 12 that is held by means of the mounting bolt 5 in the axial opening 3 of the conical tip 2. An eyelet 13 is screwed onto thread 14 at the free end of the tie rod 11 extending from the fragmentation head 6 and clamps the fragmentation head 6 to the tip 2 of the ramming drill 1. In order to prevent an unintentional loosening of the eyelet 13, the screw connection of the eyelet 13 to the tie rod 11 contains an adhesive in the region of the threads 14; when heated, the adhesive allows a release of the threaded joint.

The eyelet 13 also features an axial opening 15 in the form of a slot and a transverse hole 16 through which a mounting bolt 17 can be installed for a traction cable not illustrated. In the region of the threads 14 at the eyelet 13, there is a conically expanded region 18 that features radial cutters 19 soldered or attached by other means. The cutting edges 20 of these cutters 19 run essentially parallel to the outer surface of the conically expanded region 18 and align with the radial cutters 8 of the fragmentation head 6.

An old line 21 to be broken up features an inner diameter that is smaller than the front, cylindrical region of the eyelet 13, so that during the advance of the ramming drill 1, an initial fragmentation or at least an expansion of the old line 21 occurs due to the radial cutters 20. The radial cutters 8 at the fragmentation head 6 complete the fragmentation of the old line 21 into small pieces, and together with the conical fragmentation head 6, press the fragments into the soil 22 surrounding the pipeline 21. Since the eyelet 13 with the cutters 19 and the fragmentation head 6 with the cutters 8 are securely clamped to the conical tip 2 of the ramming drill 1 by means of the tie rod 11, the impact energy of the ramming drill 1 is transferred without play and without loss to the fragmentation head 6 and the eyelet 13, so that a fast operation is ensured in the destructive replacement of existing pipelines; yet, a simple dismantling of the fragmentation head is possible.

Figure 3:
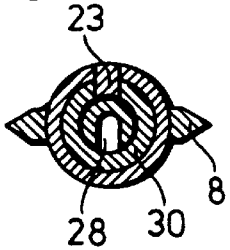

In the embodiment presented in FIGS. 2 and 3, the traction cable ends in a loop through which the mounting bolt 5 extends, with which the traction cable is directly attached to the tip 2 of the ramming drill. The fragmentation head 6 forms a guide spindle 29 with radial cutters 8 up front, and with a longitudinal slot into which an insertable strip 23 extends. This insertable strip is welded to a piece of pipe 30 through which the traction cable 28 extends. Guide casings 24 are located in front of the guide spindle 29; these casings are mounted in place by means of a cable clamp 27 on the traction cable 28. There are elastic sleeves 25 between the guide casing 24 and the traction cable 28. The cable clamp 27 and the inside of the guide casing 24 are protected by a sealing cone 26.

The guide casing 24 with the elastic sleeve 25 practically form a flexible extension of the guide spindle 29.

The cable casing composed of the elastic sleeve 25 and the guide casing 24, the cable clamp 27 and the sealing cone 26 can also be used together with the traction cable adapter 11, 12, 13 in FIG. 1.

I claim:

1. Impact drilling apparatus for destructive replacement of an underground pipe, the impact drilling apparatus comprising:

a conical tip;

a conical fragmentation head detachably mounted on the conical tip;

at least one radial blade on the conical fragmentation head, the radial blade having a cutting edge oriented substantially parallel to the conical fragmentation head, the blade extending from a point where the conical fragmentation head has a diameter smaller than that of a pipe to be replaced, to a point where the conical fragmentation head has a diameter at least equal to that of a pipe to be replaced; and a traction cable attached to the conical tip;

wherein the conical tip further comprises:

a traction cable adapter for attaching the conical tip to the traction cable through an axial opening in the conical tip; and an attachment bolt for the traction cable adapter, mounted in a transverse hole in the conical tip;

and wherein the traction cable adapter further comprises:

a tension rod with an eyelet for the attachment bolt; and a tension element on a free end of the tension rod for tensioning the fragmentation head onto the conical tip, wherein the tension element extends from the conical fragmentation head.

2. The impact drilling apparatus of claim 1, in which at least a part of the tension element adjacent the conical fragmentation head is conical and provided with at least one radial cutter.

3. The impact drilling apparatus of claim 2, comprising a pair of diametrically opposing radial blades on the conical fragmentation head, and a pair of diametrically opposing radial cutters on the tension element, wherein the radial cutters are aligned with the radial blades.

4. The impact drilling apparatus of claim 3, in which ends of the radial blades adjacent to the tension element are beveled to a diameter less than a diameter of the part of the tension element adjacent the conical fragmentation head.

5. The impact drilling apparatus of claim 1, further comprising a cable casing comprising at least one elastic sleeve around at least a part of the traction cable.

6. The impact drilling apparatus of claim 5, in which the cable casing further comprises a guide casing around the elastic sleeve.

7. The impact drilling apparatus of claim 6, in which the sleeve and the guide casing are provided with at least one axial slot.

8. The impact drilling apparatus of claim 5, further comprising a clamp on the traction cable for fixing the cable casing.

9. The impact drilling apparatus of claim 5, further comprising a sealing cone on the traction cable in front of the cable casing.

10. The impact drilling apparatus of claim 5, further comprising a guide spindle on the conical fragmentation head.

11. The impact drilling apparatus of claim 10, in which the guide spindle is provided with at least one slot, and the slot of the guide spindle can be sealed with an insertable strip.

* * * * *